United States Patent [19]

Bühler

[11] Patent Number: 4,629,133

[45] Date of Patent: Dec. 16, 1986

[54] MILL FOR FLOWABLE MATERIALS

[75] Inventor: Gerhard Bühler, Rheinfelden, Fed. Rep. of Germany

[73] Assignee: Fryma Maschinen AG, Rhinfelden, Switzerland

[21] Appl. No.: 773,103

[22] Filed: Sep. 6, 1985

Related U.S. Application Data

[63] Continuation of Ser. No. 547,652, Oct. 31, 1983, abandoned.

[30] Foreign Application Priority Data

Nov. 16, 1982 [DE] Fed. Rep. of Germany ..... 3242436

[51] Int. Cl.[4] ..... B02C 17/16

[52] U.S. Cl. ..... 241/46.11; 241/46.17; 241/79; 241/101.2; 241/171; 241/172

[58] Field of Search ..... 241/30, 33, 34, 35, 241/46.11, 46.17, 171, 172, 79, 97, 101.2, 176

[56] References Cited

U.S. PATENT DOCUMENTS

| | | | |
|---|---|---|---|
| 1,605,025 | 11/1926 | Hildebrandt | 241/176 X |
| 2,059,795 | 11/1936 | Johns | 83/45 |
| 2,595,117 | 4/1952 | Ahlmann | 241/172 X |
| 2,922,586 | 1/1960 | Hardinge | 241/97 X |
| 3,226,044 | 12/1965 | Matsubayashi et al. | 241/172 |
| 3,993,254 | 11/1976 | Bicik et al. | 241/67 |
| 4,303,205 | 12/1981 | Geiger et al. | 241/35 X |
| 4,304,362 | 12/1981 | Bühler | 241/67 |
| 4,454,993 | 6/1984 | Shibata et al. | 241/46.11 X |

FOREIGN PATENT DOCUMENTS

| | | | |
|---|---|---|---|
| 814374 | 1/1951 | Fed. Rep. of Germany . | |
| 1223236 | 8/1966 | Fed. Rep. of Germany . | |
| 3038794 | 1/1982 | Fed. Rep. of Germany . | |
| 234520 | 7/1926 | United Kingdom . | |
| 422628 | 1/1935 | United Kingdom . | |
| 489171 | 7/1938 | United Kingdom . | |
| 1069986 | 5/1967 | United Kingdom . | |
| 473522 | 9/1975 | U.S.S.R. | 241/33 |

*Primary Examiner*—Howard N. Goldberg
*Assistant Examiner*—Joseph M. Gorski
*Attorney, Agent, or Firm*—Holman & Stern

[57] ABSTRACT

A ball mill stator providing a milling space between a housing and a cover and a ring-like displacing body in the milling space with a V-shaped radial cross-section forming part of the rotor. The material being milled together with the balls flows around the displacing body from a feed inlet to an outlet along spiral paths. The milling media kept back at the milling gap are moved through a duct into an annular space and from this point through conveying ducts of an impeller outwards and re-enter the milling space at a small distance above the feed inlet. The impeller is sealed between the rotor and stator and is powered by a motor, or by a variable speed drive, run at a speed controlled by readings taken from different parts of the mill system such that the milling media is evenly distributed in the material being milled by which they are moved along making the milling operation more uniform and efficient. An adjustable milling ring together with the impeller form a coarse milling unit whose gap size may be changed like that of the inlet.

16 Claims, 3 Drawing Figures n1
n2
a
b

MILL FOR FLOWABLE MATERIALS

This is a continuation of application Ser. No. 547,652, filed 10-31-83, now abandoned.

BACKGROUND OF THE INVENTION

1. Field of the Invention

The present invention relates to ball mills for the milling of flowable materials, and more specially to such a mill of the type having a centered milling space between a stator and a rotor through which flows freely moving grinding media and the material to be milled, that is supplied through an inlet and is let out through an outlet at which there is a separator for separating and keeping back the grinding media from the milled material so that the media may be run through a return duct to the inlet.

2. Description of the Prior Art

The German Offenlegungsschrift specification No. 2,811,899, which corresponds to U.S. Pat. No. 4,304,362, describes a ball mill designed on these lines and in the case of which the material to be milled and the grinding media are kept circulating round a displacing ring of wedge-like cross section, the material outlet and the material inlet being placed quite near to the axis of the mill so that the grinding balls separated by the separating unit may be run back through a return duct and then into the material in the process of being milled. In this case, the return duct is designed running through a disk on the rotor and is radial so that the media are moved therethrough by centrifugal force.

In order, in the case of mills of this type, to make certain of a more or less even distribution of the material to be milled and of the grinding media, the rate of flow of the media and of the material have to have a certain relation to each other. The rate of flow of the material being milled may for example be changed as desired by changing the supply pressure and the speed of the rotor. Although the grinding media are moved by the material to be milled, the driving force acting in this respect is more importantly controlled by the viscosity of the material. Furthermore, the speed of the rotor has a limited effect on the circumferential speed of the said material and of the media. Because, however, the relation between the circumferential speeds cannot be controlled to keep it at a constant value, the operation of the mill, that is to say its effect on the material supplied thereto, will not be constant. Although some attempts have been made to make changes in the speed of circulation of the grinding balls by changing the size of the return duct or ducts, such adjustments are as a rule only possible when the mill is empty. Furthermore the adjustments are not great enough.

BRIEF SUMMARY OF THE INVENTION

Unlike this earlier design of mill, the present invention is based on a generally different technical idea and in fact has the purpose of making such a further development of prior art mills that controlling and matching the speeds of circulation of the material to be milled and of the grinding media becomes simpler and more exact.

A still further purpose of the invention is to make a more even milling operation possible.

An even further purpose or object of the invention is that of so designing a mill that the milling effect is better than in the prior art.

For effecting these and further purposes of the invention that will become clear later on reading the present specification and claims, the mill is so designed that the return duct or means has at least one separate conveying means for causing a positive change in the return rate of the grinding media in relation to the speed of circulation of the material to be milled, said conveying means having a conveying drive able to be run at a speed different from the speed of the rotor drive.

In this way it now becomes possible for the speed of circulation of the grinding media to be positively controlled independently of all other drive operations and speeds, and such control may then be so undertaken that it is near to its optimum value. Adjustment thereof to a certain desired value is possible, if the operation parameters of the mill are in other respects kept unchanged, as will normally be the case when the mill is being run continuously. When starting up it will be quite simple for the right adjustment of the running speed, and for this reason of the necessary speed of circulation of the grinding media, to be produced simply by testing the end product. Then if necessary further tests may be undertaken or changes in the parameters of operation of the mill may be monitored so that any undesired changes in the said speed ratios will be noted and corrected.

It this respect the purpose is to see that there is such a return speed that there will be a certain pile-up or build-up of the grinding media upstream from the return means, such build-up running back some distance into the milling zone. If the return speed is too high the pressing effect of the balls will be overly small so that the milling effect of the mill will be reduced and the mill driving motor will use less power. If on the other hand the return speed is too low, there will be an overly large build-up so that the balls will be overly strongly forced together and there will not be a great enough rolling effect of the balls against each other and on the wall of the milling space, this in itself decreasing the milling rate and increasing the milling temperature because of the friction. In keeping with the invention on the other hand the build-up and the pressing force are controlled directly by changing the return speed.

In keeping with a first working example of the present invention the conveying drive is completely independent from the rotor drive. This mechanical design is simple; it does however do little to make control any simpler.

On the other hand a conveying drive designed to be run with a fixed or variable ratio between it and the rotor drive is more complex to make, but it makes control more exact. To take an example, the rotor and the conveying means may be powered from a common drive by way of a variable ratio transmission.

The conveying means may be usefully designed in the form of a centrifugal pump that is able to take effect on the grinding media directly and for example has a pump impeller turning on the axis of the mill. The size and placing of the pump impeller system may in this respect be such that when the mill is running more or less normally, the speed of the pump impeller is of the same order as the speed of the rotor and it is only for control purposes that it has to be decreased or increased without producing any sharp changes in speed of the grinding media.

The centered placing of the parts furthermore makes for a very compact and functional design, more specially if the pump impeller, that in any case is sealed off, is placed between the rotor and the stator. In this respect it is best for the drives for the rotor and the pump impeller to be joined up from opposite sides.

The conveying pump is best designed so that the separate conveying ducts therein have a clearance width that is a little larger than the greatest cross section or two times such cross section of the grinding media that are to be moved in order to make certain that there is no chance of the ducts becoming stopped up. In this respect it is best if the number of grinding media moving therethrough at a time is limited to one or four to five.

It is furthermore best if the outlet of the centrifugal means and the inlet for material into the mill to be placed generally in the same circumferential area right next to each other axially so that the material to be milled and the grinding media are moved evenly into the milling space radially.

If a milling means is to be placed upstream from the inlet for the material to be milled, such milling means is best placed between the impeller of the pump and the mill housing. A useful effect is to be had in this respect if a ring-nozzle is formed by the material inlet between the conveying impeller and the housing of the mill, such nozzle stopping motion of the grinding media back into the system when the mill is not running and being next to a group of milling faces, functioning with each other, on the pump impeller and the mill housing. At least one of the two milling faces may then have teeth like those of a toothed colloid mill.

The clearance width of the ring or annular gap is at the most half the size of the grinding media. The width of the ring gap and/or the width of the milling gap may furthermore be adjusted by axially moving the milling ring, more specially if it is a common one.

A more specially useful effect is produced in this connection if there is a control system, and more specially an automatic one, for adjustment of the conveying drive in keeping with the mill operation parameters and/or the properties of the material to be milled. Such a controller may for example be joined up with at least one means sensing the drive power, the drive torque and/or the speed of turning of the mill drive. It is furthermore possible for the controller to be joined up with at least one means sensing the viscosity or the pressure of the material being milled. In this respect the viscosity before milling and the viscosity produced on milling may be equally important. The ratio between the two viscosities may be important as well. It will be clear that other properties or data with respect to the condition of the material milled and further data having a bearing on the operation of the mill may be of value.

Because the different readings and data to be processed make necessary quite different controlling systems, it is best for a number of sensing means to be joined up with an averaging unit, as for example one based on a computer, so that an output control signal for the conveying drive may be produced thereby from the different readings and data using an algorithm.

BRIEF DESCRIPTION OF THE DRAWINGS

A detailed account will now be given of working examples of the invention description with reference to the accompanying drawings wherein.

DETAILED DESCRIPTION

Figure 1:
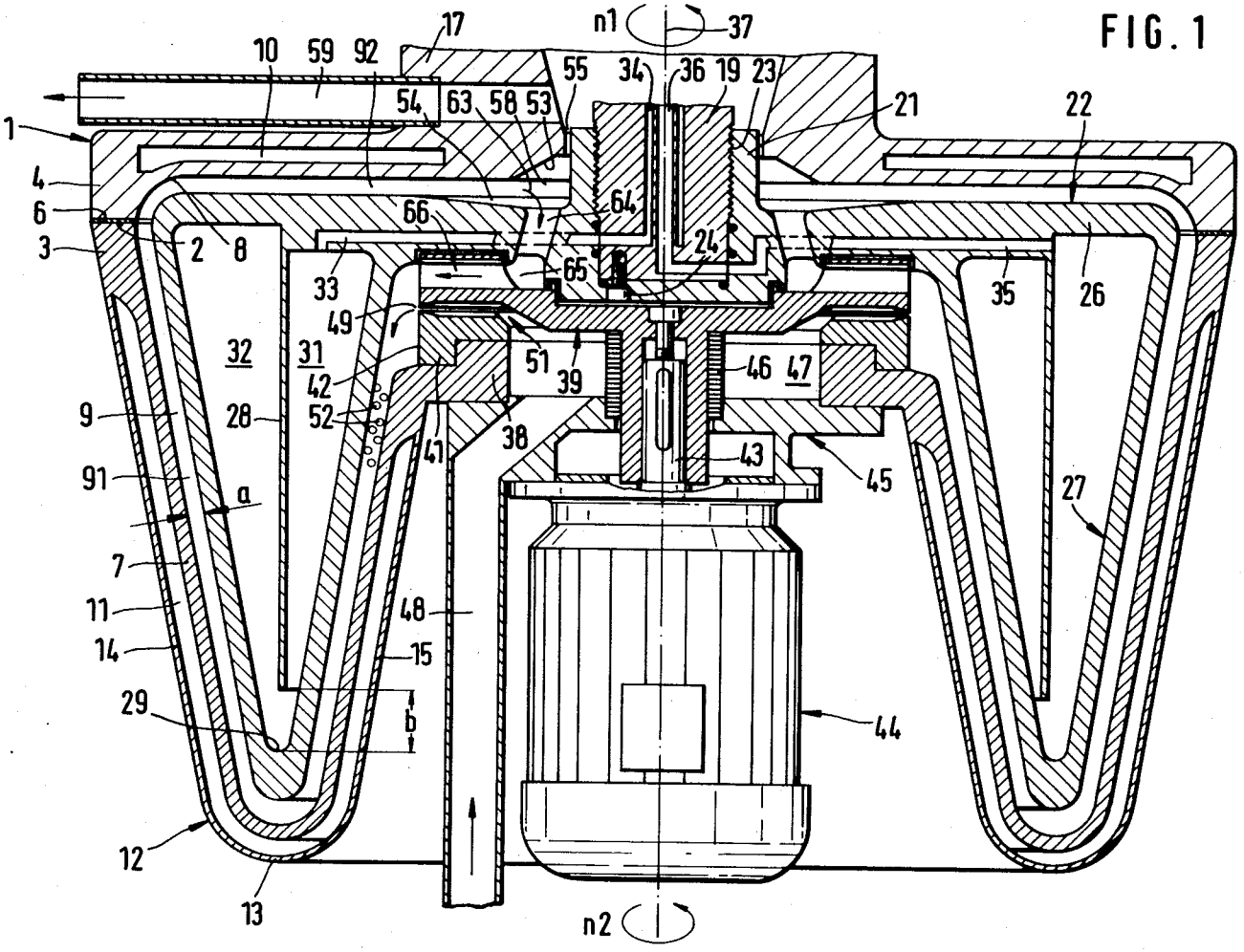
FIG. 1 is a cross-sectional view through a gap-type ball mill in keeping with the present invention.

The stator 1 of the gap-type ball mill to be seen in FIG. 1 is cut up into two parts by a generally level parting plane 2, the parts being a lower mill housing 3 and a cover 4, that are clamped together by screws (not shown) so that a fluid-tight joint is produced therebetween, such joint having in it ring-like structures 6 with the function of gaskets and/or shims for adjustment of the axial position of the rotor in relation to the stator. The mill housing has a housing wall 7 with a cross-sectional form like an upright letter V, that is to say becoming narrower in a downward direction with a wedge-like radial section with frusto-conical inner and outer faces. The milling or grinding space 9 is walled in by such housing wall 7 and the cover 4 and is double-conical in cross-sectional form. The milling space is to some degree taken up in the cover 4 inasfar as it has a downwardly opening hollow portion 8 therein.

On the outside of the housing wall 7 there is cooling space 11 formed within a cooling jacket 12 with a lower wall 13 and ring walls 14 and 15. As a general point, it would be possible for all of the mill to be supported by this jacket 12, that would be made in one piece with the mill housing. However the mill may be hangingly supported from the cover 4, which would then be supported by a stand.

A further cooling space 10 is formed in the cover 4, whose bearing housing 17 is designed for supporting a rotor shaft 19 by way of a normal bearing system not detailed here. The lower end of the rotor shaft 19 is taken up in a hub 21 of the rotor 22 and screwed therein by way of a screw thread 23. It is locked in the hub by a set screw 24.

The rotor 22 has a rotor disk 26 running out from the hub 21, the disk having at its outer edge a ring-like hollow displacing body 27 or skirt with a double conical form matching the form of the housing wall 7. This displacing body is disposed in the milling space 9, forming with the housing wall 7 a milling gap 91 with roughly the same and unchanging width a.

The space inside the displacing body 27 is walled off by a generally cylindrical parting wall 28 running out and down from the rotor disk 26. The parting wall 28 comes to an end at a distance b from the ring-like floor 29 of this inner space so that the said inner space is in fact walled off into an inner ring space 31 for inner cooling of the rotor and an outer ring space 32 for circulation of the coolant. The inner space 31 is joined up by a more specially radial duct 33 in the rotor disk 26 with an outer ring duct 34 in the rotor shaft 19. The outer ring space 32 is joined up by way of a duct 35 designed on the same lines with a centered hole 36 in the rotor shaft 19. Seeing that the ducts 33 and 35 are placed diametrically, the coolant is able to make its way in the inner ring space 31 downwards and in the outer ring space 32 upwards and has to make its way tangentially around at least half the circumference of the parting wall 28 before it comes out of the system. The inlet and outlet may furthermore be placed tangentially for producing a twisting cooling flow and for this reason a more even effect.

A pump impeller 39 is bearinged so that it is in a position between the rotor disk 26 and an upper inwardly running ledge 38 of the mill housing 3, the impeller having an outer cylindrical face that is in line with the outer cylindrical face 42 of a milling ring 41 seated on the inner ledge 38. It is desirable for means to be provided for axial adjustment of the ring 41. The impeller 39 is keyed on the motor output shaft 43 of a drive, more specially in the form of an electric conveying motor 44, that is joined to ring 45 fixed on the inner ledge 38. An annular space 47 is walled in between the parts 38, 41, 39 and 45 and it is sealed off by a gland 46. There is an inlet duct 48 opening in an upward direction into the annular space 47 and on the outlet side of the space 47 there is a feed or material inlet 49 (formed between the milling ring 41 and impeller 39 in the form of a ring-like gap) forming a connection with the milling space 9.

Upstream from the feed inlet 49 there is a coarse milling unit 51 that is formed by two toothed structures in the milling ring 41 and the pump impeller 39 for functioning as a colloid mill.

The unmilled material or feed supplied in the duct 48 for this reason makes its way through the annular space 47 and the coarse milling unit 51 to the feed inlet 49 in the form of the annular gap. The clearance width of the ring gap is made so much smaller than the cross section of the material to be milled that this in itself is responsible for stopping any backward flow when the mill is not running. The clearance width of the feed inlet and of the milling gap of the coarse milling unit may be adjusted by axially changing the position of the milling ring 41 by the use of shim rings. From the feed inlet 49 the material to be milled makes its way along a conical spiral in the inner part of the milling gap 91 in a downward direction, then in an upward direction spirally on the outer side of the displacing body 27 and lastly radially inward on the top side of the rotor disk 26 in the milling gap. At the same time milling balls 52 are moved along with the feed in which the same are more or less evenly distributed. These milling balls keep on being turned on coming up against the rotor and are rolled along first on the fixed face on one side of the milling gap 91 and then on the moving face on the other side of it and so on in in turn.

Seeing that the material is moved the right way around the displacing body 27, in the limited milling space there is very frequent contact between the milling balls and the grains of the feed or material to be milled. In this respect the motion of the feed around the system is more importantly dependent on the pumping pressure in the inlet duct 48 and the force keeping the balls on the move is largely dependent on the viscosity of the material to be milled that is being moved through the mill. For this reason, however, the driving force acting on the milling balls is more or less completely independent of the rate of transport of the feed through the mill, such balls forcing along the balls in front of them by way of the part 92 of the milling gap radially inward.

While the relatively light feed is moved upwards along the cone face 53, the milling balls, that are larger in size, keep right up against the topside of the rotor disk 26 in the shallow conical hollow 54, or away from the outlet gap 55 forming a separating unit in the outer limit of a separating space 58. For this reason it is possible for material, freed of milling bodies, to flow through gap 55 into the outlet duct 59 running outwards from the sleeve or bearing housing 17, such duct being shut off from the rotor shaft 19 and its drive.

The milling balls on the other hand make their way in the direction of the arrow 63 out of the separating space 58 through openings 64 in the rotor disk 26 into a further annular space 65 between the rotor disk and the pump impeller 39. There are ducts running at least partly radially from the space 65 as far as the outer cylindrical face on the impeller common to cylindrical face 42 right over the feed inlet 49 into an annular gap. The cross section of the ducts 66 is in this respect made somewhat larger than the cross section of the largest milling balls used, which for this reason are thrown outwards by the turning impeller 39 at a low radial speed. To make certain that the feed, acted on by a high supply pressure, is not able to be pushed in the centrifugal pumping direction through the path 63–66, but instead to the outlet gap 55, this supply pressure and the centrifugal force (that is largely controlled by the speed of turning) have to be adjusted to be in line with each other. However the speed n2 of turning of the pump impeller 39 has to be adjusted at least to take into account the speed n1 of turning of the rotor 22. It is furthermore necessary for the viscosity to be taken into account, if an even distribution within the feed is to be kept up.

The cross section of the ducts 66 is made such that at one and the same time only one or four to five balls are to be moved therethrough. In the first case the diameter of the ducts (that are for the most part cylindrical) will be 1.2 to 1.4 times the diameter of the milling balls, whereas in the second case the duct diameter is 2.2 to 2.4 times the diameter of the milling balls. It is in this way that one may more or less be certain that there will be no trouble caused by the milling balls jamming in the ducts and in fact they will be quickly moved through the ducts without producing any very great pressure on their inner faces.

Figure 2:
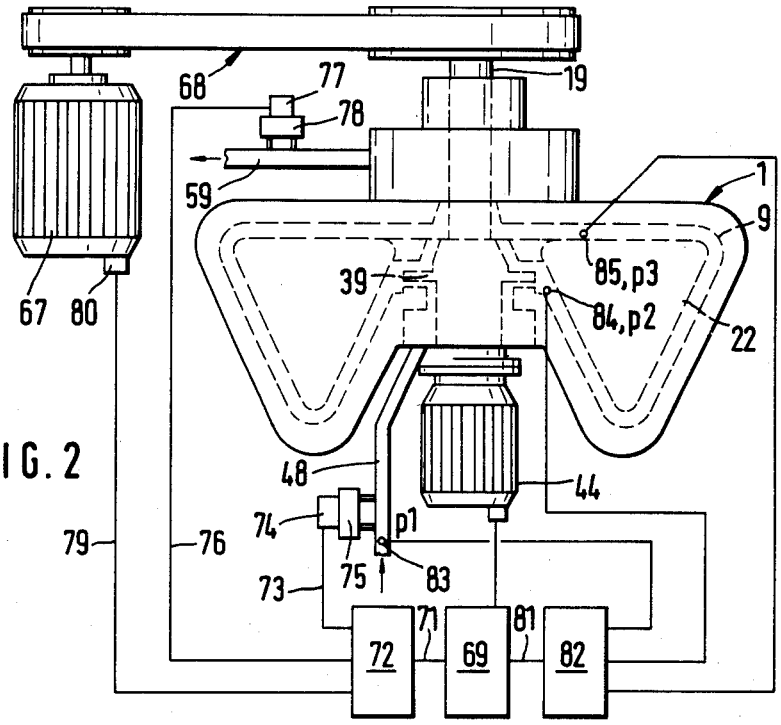
FIG. 2 is a schematic elevational view of the invention showing the circuit thereof.

The mill driving motor 67, that from FIG. 2 will be seen to have a belt drive 68 for driving the rotor shaft 19, may be a constant speed motor. However as a rule the motor will be a variable speed one in this case as well. The conveying motor 44 is however controlled by an averaging unit 69, that receives a first input value by way of wire 71 from a computing unit 72, that is joined by way of a wire 73 with a first data transmitter 74 continuously supplying first viscosity readings from a first viscosity gage or pick-up 75, that is joined with the feed duct 48.

There is a further duct 76 running to the second data transmitter 77 of a second viscosity gage 78 on the output duct 59 and a third duct 79 running to a data transmitter 80 joined directly or indirectly with the mill motor 67, such transmitter 80 supplying for example data with respect to the instantaneous power output, the current and/or the speed of the motor. It is furthermore possible to have separate sensing means for sensing more than one of such forms of data.

The averaging unit 69 is furthermore joined by way of a line 81 with a computing unit 82, that is joined by way of three lines with data transmitters 83 for the pressure p1 in the supply duct 48, 84 for the pressure p2 in the inlet part of the milling space 9 and 85 for the pressure p3 in the outlet part of the milling space.

Because it is only the speed of the conveying motor 44 which is to be controlled, it is necessary for the right average value to be worked out from the different data. There are a number of different ways of doing this, one of them being more specially by using electronic computers transmitting a single data quantity and a single control command to the conveying motor 44 by way of the averaging unit.

It will be seen from FIG. 2 that first output values are worked out by the computing units 72 and 82 in keeping with a given algorithm, such values being averaged again in the common averaging unit 69. The division of the system seen in FIG. 2 is not necessary if all the readings are supplied to a common computer for forming the average value signal, amplifying it and supplying it to the conveying motor 44.

Figure 3:
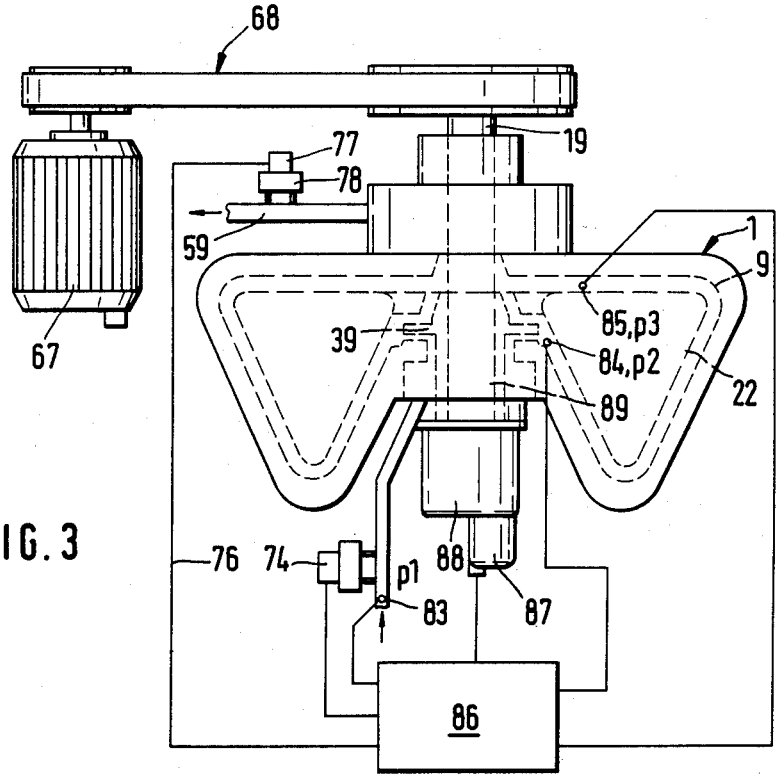
FIG. 3 is a view similar to FIG. 2 showing a further embodiment of the invention.

Such a single or central computer 86 will be seen in FIG. 3, in which case however it is not the conveying motor 44 but a controller 87 for a stepless transmission 88 that is controlled by the computer 86. The transmission 88 is joined with a hollow shaft 89 running to the impeller 39, the rotor shaft 19 running down through the shaft 89. In this case there is no need to have the duct 79 running to the mill motor 67, because generally speaking there is a connection between the speed of the conveying drive and the mill motor. In other words no secondary adjustment or feedback control is needed when there is a change in the speed of the mill motor, since no such secondary adjustment is made necessary by there being different input values. In this case as well it is not necessary for all the data gages or pickups to be joined up and sometimes the system may be run with a single data pick-up for feedback control.

Furthermore the stepless transmission 88 may be placed outside the mill housing on the motor 67 so that there will then be no need for the rotor shaft 19 to pass through it.

If at all possible the speeds of the rotor 22 and of the pump impeller 39 are to be roughly equal in normal operation so that there is then no unnecessary relative motion at the common interface. The measurement of the viscosity furthermore does not have to take place continuously but may be taken only at certain times so that feedback control will only be at such times as well. In most cases only one measurement of viscosity is needed if the control algorithm is based on empirical data. It will furthermore be clear that readings from other parts of the system, as for example a reading with respect to a pile-up of milling balls in the separating space 58, may be used. Generally there is nothing to be lost in supplying a part of the material to be milled with the balls back into the feed inlet so that, in other words, it is processed a second time. In fact it is even possible for the average processing time to be greatly increased using the milling body conveyor, that is to say the material is run through the system 1.5 to 2.5 times on an average so that it is better homogenized to a degree in keeping with this.

I claim:

1. In a mill for processing flowable material to be milled having a mill stator, a rotor within the stator in spaced relation thereto to form a central milling gap, milling media for flowing through said gap with the material to be milled at a certain rate, said milling media being distributed in the material to be milled, a rotor drive for driving the rotor at selected speeds, an inlet and an outlet for the material to be milled connected to the milling gap, a separator to separate the milling media from the material milled, and a milling media return for returning separated milling media to the milling gap, the improvement wherein the separator is upstream of the outlet and the milling media return comprises:

a separate centrifugal pump having an impeller centrally disposed between the stator and the rotor and rotatably mounted with respect to the stator and the rotor;

impeller drive means for driving said impeller at selected speeds; and means for controlling the speed of said impeller drive means to selectively rotate said impeller at a speed different from the speed of the rotor to control the distribution of the milling media within the material being milled.

2. The mill as claimed in claim 1 wherein said impeller drive means is separate from said rotor drive.

3. A mill as claimed in claim 1 wherein said impeller drive means comprises:

a speed changing transmission operatively connected to said impeller and to the rotor drive so that the speed of the impeller can be varied with respect to the speed of the rotor.

4. A mill as claimed in claim 1 wherein;

said impeller drive means is steplessly adjustable.

5. A mill as claimed in claim 1 wherein said milling media have a cross-sectional size, and said centrifugal pump further comprises:

separate conveying ducts in said impeller, said conveying ducts having a cross-sectional size slightly greater than one-to-two times the cross-sectional size of the milling media.

6. A mill as claimed in claim 1 wherein said milling media flow through said milling media return at a rate, said material to be milled flows at a pressure, said mill has a central axis, said rotor rotates about the central axis, said control means is adapted to produce a positive change in the rate of return of the milling media in relation to the pressure of the material to be milled; and further comprising:

bearing means rotatably supporting said impeller in said stator for rotation about the central axis of the mill;

seal means to seal said impeller between the rotor and stator;

a face on said stator through which the material inlet extends; and an outlet in said impeller for the milling media, said outlet being positioned in a face of said impeller and substantially aligned in the direction parallel to said central axis with said face on the stator through which the material inlet extends and axially adjacent to said material inlet.

7. A mill as claimed in claim 6 wherein said impeller drive means comprises:

a drive means separate from said rotor drive and disposed on a side of said stator substantially opposite from said rotor drive.

8. A mill as claimed in claim 6 and further comprising:

a milling means upstream of the material inlet and between said impeller and stator for milling material to be milled flowing to the material inlet.

9. A mill as claimed in claim 6 wherein the material inlet further comprises:

an annular gap between the impeller and the stator adapted to produce a nozzle function; and cooperating milling faces on the stator and said impeller communicating with said annular gap and being disposed radially inwardly thereof.

10. A mill as claimed in claim 9 wherein at least one of said milling faces comprises a toothed structure so that the milling faces function as a toothed colloid mill.

11. A mill as claimed in claim 9 and further comprising:

a clearance width formed by said annular gap;

means for adjusting said clearance width of said annular gap and the milling gap between the milling faces by axial movement.

12. A mill as claimed in claim 11 and further comprising:

a common milling ring mounted between the stator and said impeller for axial adjustment; and wherein said means for adjusting the clearance width comprise said common milling ring.

13. A mill as claimed in claim 6 wherein said material to be milled has measurable properties, and said means for controlling the speed of said impeller drive means comprises:

a control system having a sensing means to sense one of the properties of the material to be milled and an operating parameter of the mill.

14. A mill as claimed in claim 13 wherein said sensing means senses one of the power output of said rotor drive, rotational speed of the rotor drive, torque on the rotor drive, pressure ratio between points in the mill through which the material to be milled flows; and supply rate of the material to be milled.

15. A mill as claimed in claim 13 wherein one of said properties of the material is viscosity and said sensing means comprises at least one means for sensing said viscosity of the material to be milled.

16. A mill as claimed in claim 13 wherein said control system comprises:

a plurality of said sensing means; and an average value computing unit operatively connected to said sensing means to produce a resultant control signal therefrom based on a given algorithm.

* * * * *